United States Patent [19]

Satriana et al.

[11] 4,082,584

[45] Apr. 4, 1978

[54] BALLISTIC MODIFIER

[75] Inventors: Daniel R. Satriana, Verona; Arthur J. Bracuti, Dover, both of N.J.

[73] Assignee: The United States of America as represented by the Secretary of the Army, Washington, D.C.

[21] Appl. No.: 114,707

[22] Filed: Feb. 11, 1971

[51] Int. Cl.[2] ..... C06B 43/00

[52] U.S. Cl. ..... 149/109.4; 149/92; 149/97; 149/100; 260/429.7; 260/435 R

[58] Field of Search ..... 149/92, 97, 100, 109, 149/109.4; 260/429.7, 435 R

[56] References Cited

U.S. PATENT DOCUMENTS

| | | | |
|---|---|---|---|
| 1,938,585 | 12/1933 | Estabrooke | 260/435 R |
| 2,849,420 | 8/1958 | Stevens et al. | 260/429.7 |
| 3,032,972 | 5/1962 | Preckel | 149/100 X |
| 3,033,717 | 5/1962 | Preckel | 149/100 |
| 3,093,653 | 6/1963 | Webster | 149/109 X |
| 3,201,452 | 8/1965 | McKusick et al. | 149/109 X |
| 3,379,588 | 4/1968 | Corsi et al. | 149/100 X |
| 3,417,115 | 12/1968 | Stamm | 260/429.7 |
| 3,445,306 | 5/1969 | Satriana | 149/100 X |
| 3,480,656 | 11/1969 | Heiss | 260/429.7 |

*Primary Examiner*—Edward A. Miller

*Attorney, Agent, or Firm*—Nathan Edelberg; Harold H. Card, Jr.; A. Victor Erkkila

[57] ABSTRACT

A ballistic modifier produced as the product of the pyrolysis of heavy metal oxides and various ureas.

13 Claims, 10 Drawing Figures

BURNING RATE CURVE OF HMX (30%) PLASTISOL PROPELLANT CONTAINING PYROLYZED $PbSnO_3$ /UREA MODIFIER

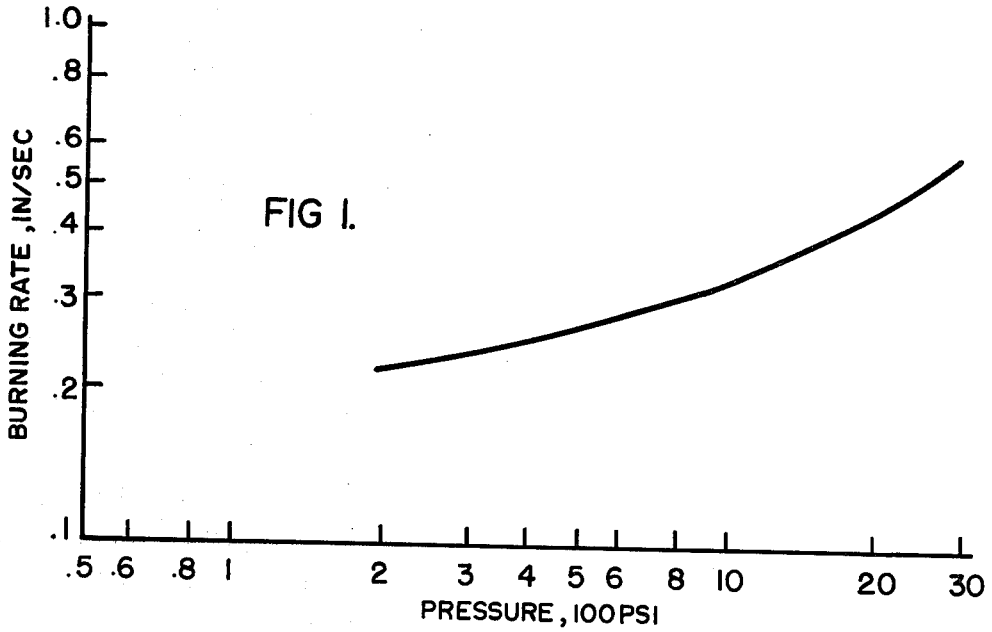
BURNING RATE CURVE OF HMX (30%) PLASTISOL PROPELLANT CONTAINING PYROLYZED $PbSnO_3$ /UREA MODIFIER
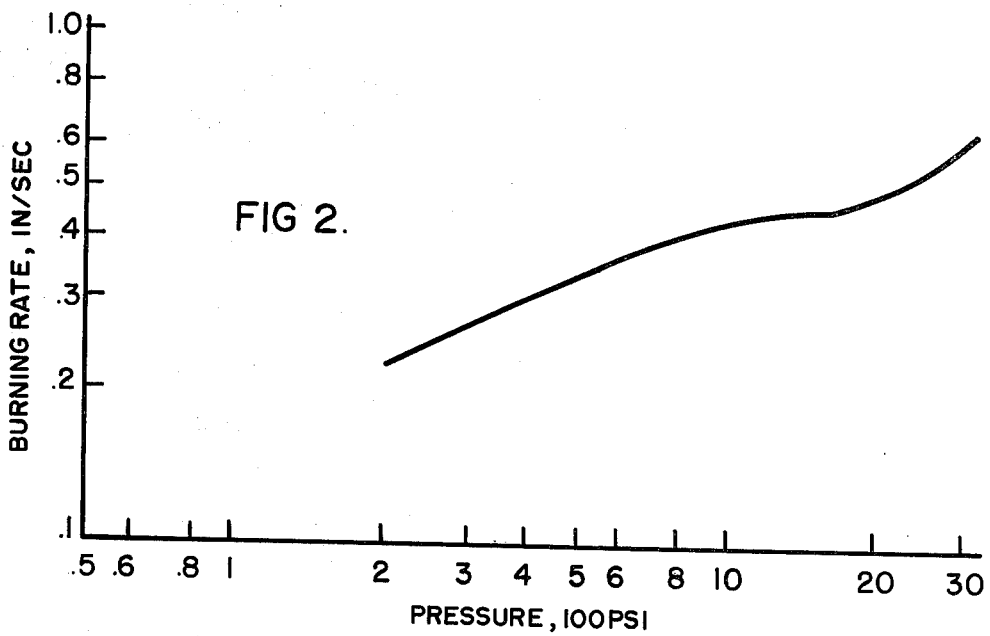
BURNING RATE CURVE OF HMX (30%) PLASTISOL PROPELLANT CONTAINING PYROLYZED $PbSnO_3$/ PHENYL UREA MODIFIER

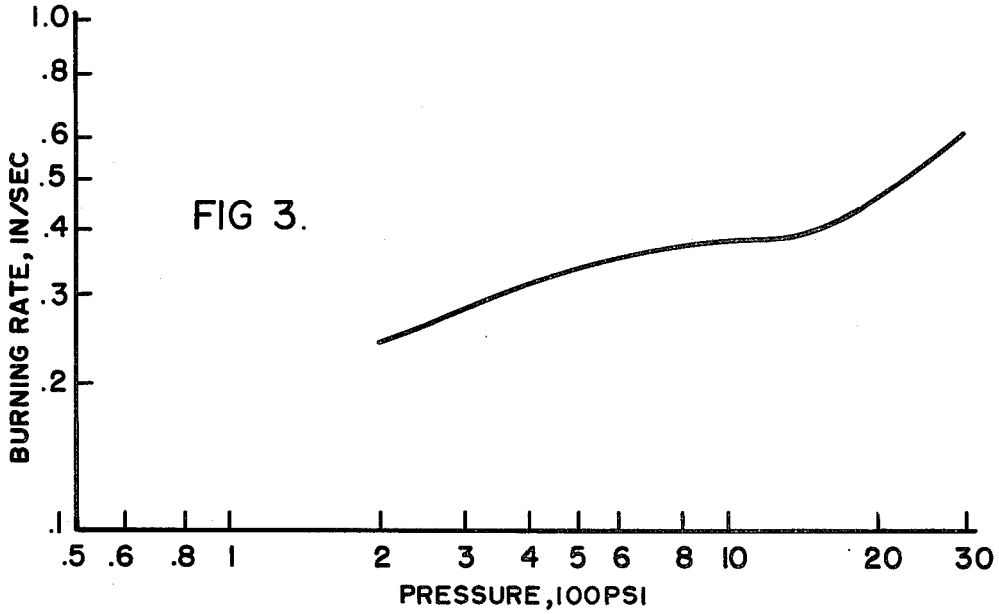
BURNING RATE CURVE OF HMX (30%) PLASTISOL PROPELLANT CONTAINING PYROLYZED $PbSnO_3$/DIPHENYL UREA MODIFIER
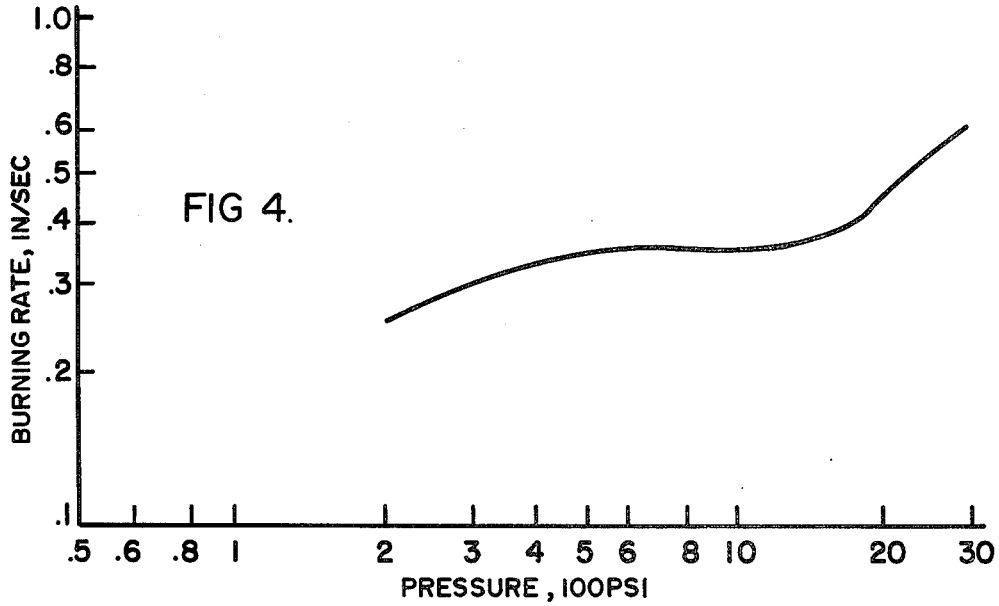
BURNING RATE CURVE OF HMX (30%) PLASTISOL PROPELLANT CONTAINING PYROLYZED $PhSnO_3$/ETHYL CENTRALITE MODIFIER

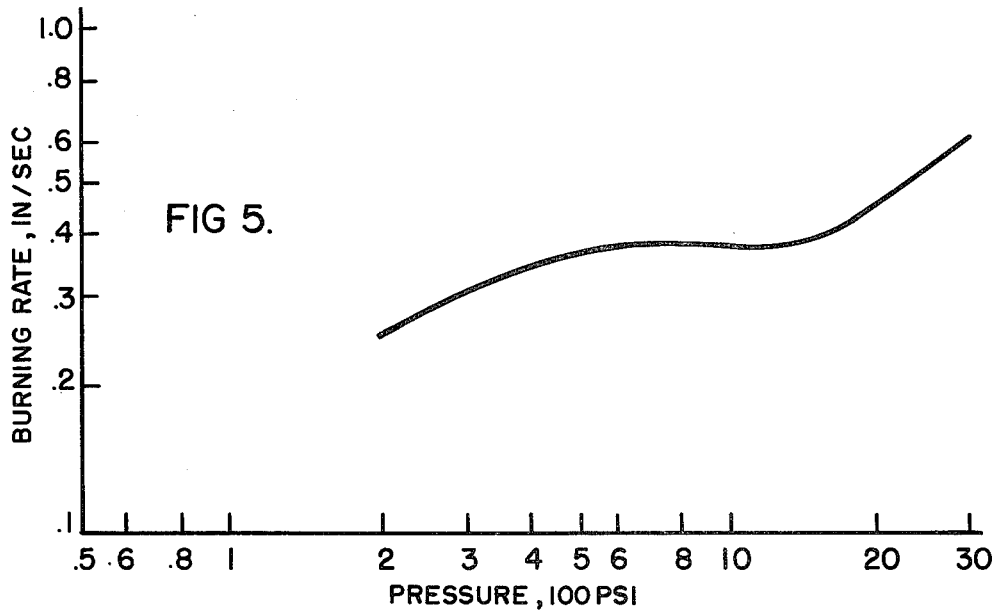
BURNING RATE CURVE OF HMX (30%) PLASTISOL PROPELLANT CONTAINING PYROLYZED $PhSnO_3$/TDI-UREA MODIFIER
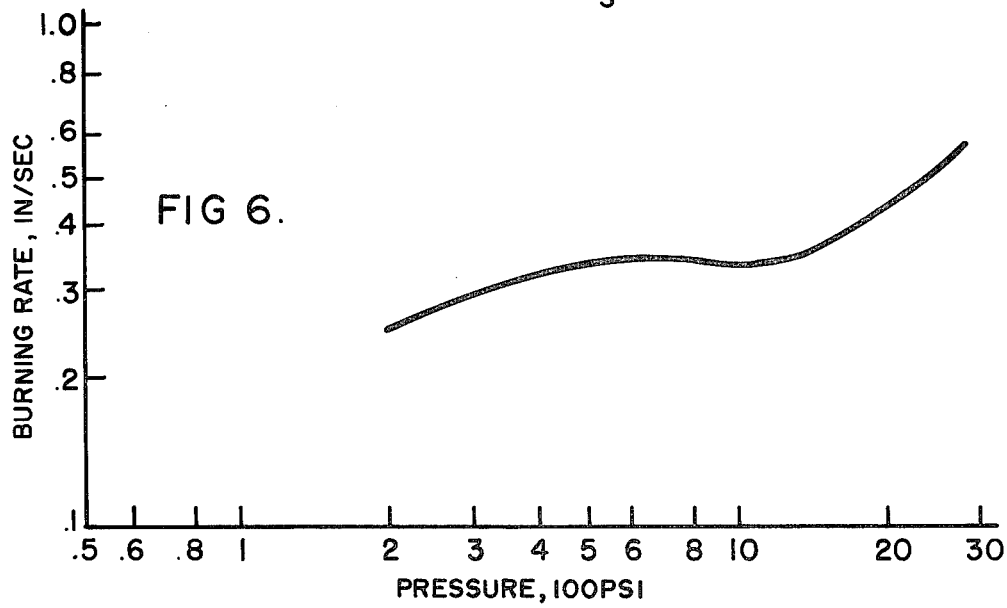
BURNING RATE CURVE OF HMX (30%) PLASTISOL PROPELLANT CONTAINING PYROLYZED $PbSnO_3$/HEXAMETHYLENE MODIFIER

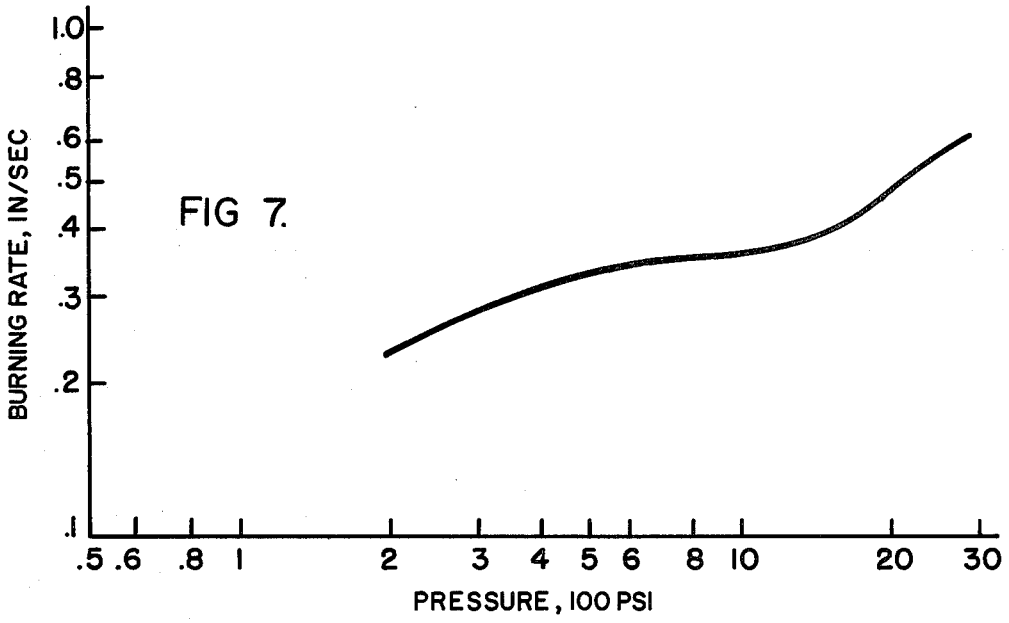
BURNING RATE CURVE OF HMX (30%) PLASTISOL PROPELLANT CONTAINING PYROLYZED $PhSnO_3$ METHYENE-DI-p-PHENYLENE MODIFIER
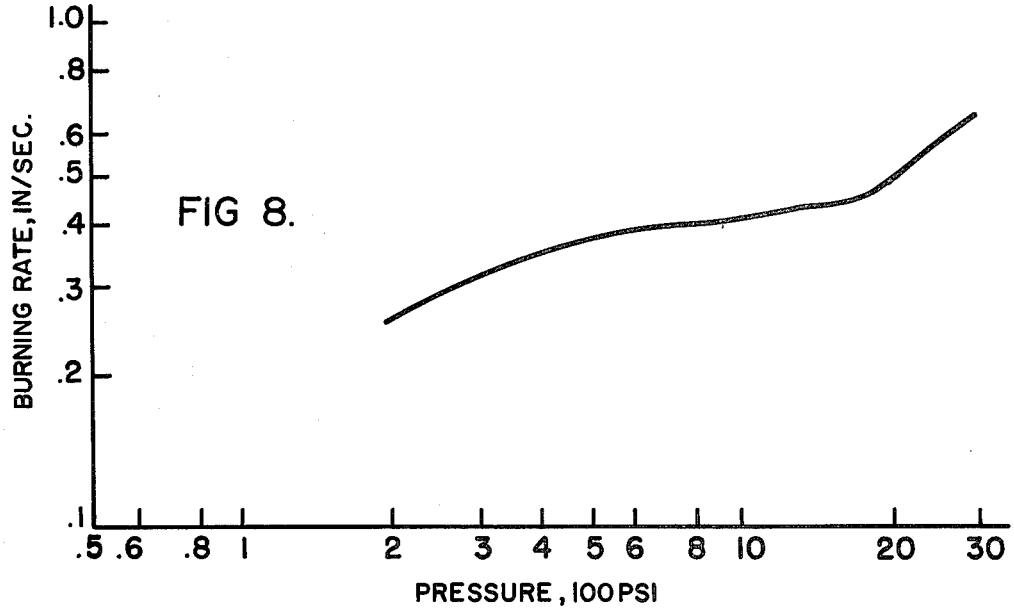
BURNING RATE CURVE OF HMX (30%) PLASTISOL PROPELLANT CONTAINING PYROLYZED $PbSnO_3$ / 10% TDI MODIFIER

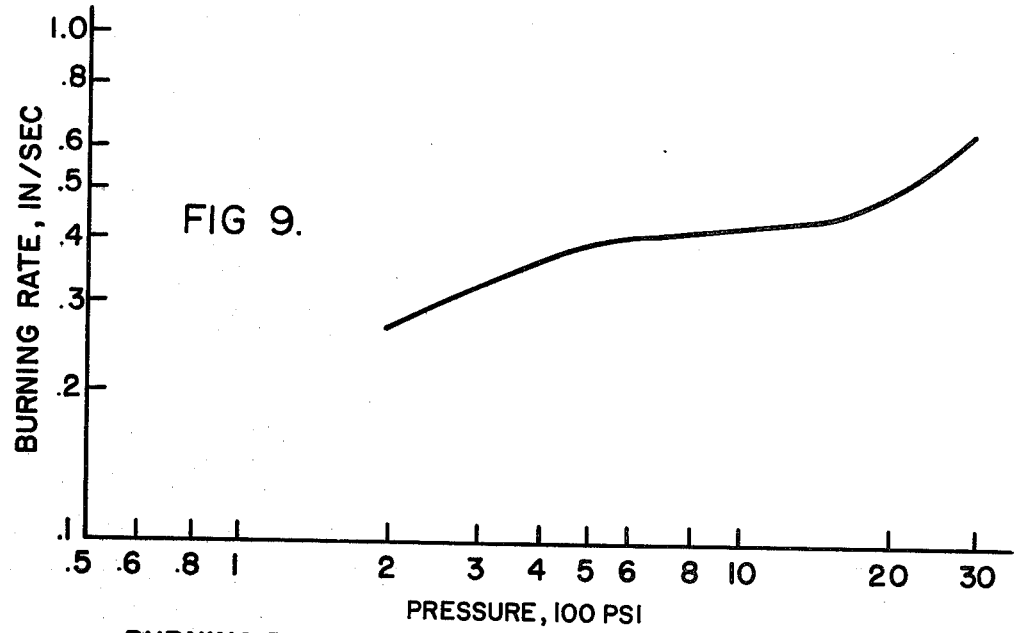
BURNING RATE CURVE OF HMX (30%) PLASTISOL PROPELLANT CONTAINING PYROLYZED $PbSnO_3$/15%TDI MODIFIER
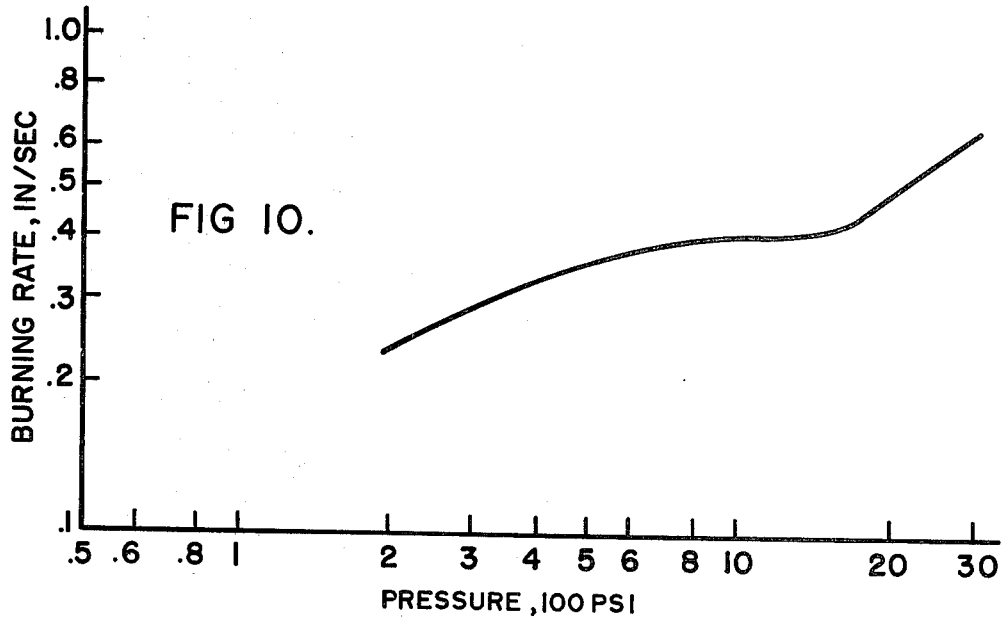
BURNING RATE CURVE OF HMX (30%) PLASTISOL PROPELLANT CONTAINING PYROLYZED $PbSnO_3$/20% TDI MODIFIER

BALLISTIC MODIFIER

The invention described herein may be manufactured, used and licensed by or for the Government for governmental purposes without the payment to us of any royalty thereon.

BACKGROUND OF THE INVENTION

This invention relates to a ballistic modifier for use in a double base plastisol rocket propellant in which a burning rate characterized by a plateau effect is desired.

The burning rate of a propellant at a given temperature is in direct relationship to the pressure to which it is exposed. Mathematically the relationship is expressed as: $R = cp^n$ where R is the burning rate, $p$ is the pressure and $c$ and $n$ are constants determined by the type of propellant used.

Where $n$ equals zero or some negative value, the burning rate will exhibit a plateau or mesa effect. Propellants exhibiting either a plateau or mesa effect give a constant or decreasing burning rate and as a result a steady thrust. Thus vehicles using such propellants exhibit flatter and more ascertainable trajectories.

Currently, desired plateau burning rates are imparted to propellants by the use of ballistic modifiers which are essentially lead and/or copper salts of aromatic acids.

The present invention consists of a metallic complex formed as the product of the pyrolysis of heavy metal oxides and various selected ureas. The complex formed has been found to be a highly effective ballistic modifier producing plateau ballistic characteristics in a high energy smokeless nitramine plastisol propellant system.

It is an object of this invention to provide an improved ballistic modifier.

A further object of this invention is to provide a novel carbonaceous metal-metaloxide mixture and a process for producing same.

A still further object of this invention is to provide a ballistic modifier which produces plateau burning characteristics in a high impulse nitramine plastisol propellant composition.

Yet another object is to provide a process for producing a ballistic modifier which is inexpensive, less time consuming and does not require strict procedural control.

Other objects and many of the attendant advantages of this invention will be readily appreciated as the same become better understood by reference to the following detailed description.

The present modifier is produced independently of the propellant by mixing a metal oxide and a urea and heating the mixture to an elevated temperature such that a pyrolysis occurs.

A preferred method of effecting the above consists of mixing lead stannate and a urea compound and transferring the mixture to an aluminum container which is covered with aluminum foil. The foil is slit in several places and the container is placed in a muffle furnace at a temperature of between 500° to 550° C. When the initial reaction is completed (smoke no longer evolved), the container is removed and quickly sealed with aluminum foil. The sealed container is again placed in the furnace and after heating at 500° to 550° C for one hour, the container is removed and the contents allowed to cool over night without exposure to air. The pyrolyzed mixture (ballistic modifier) is sieved through a No. 325 mesh screen and is then suitable for incorporation into a plastisol formulation in which plateau burning rates are desired.

The metal compounds which were found to be effective include lead stannate, mixtures of lead oxide (10% to 90%) and stannic oxide (90% to 10%), and mixtures of lead sesquioxide (10% to 30%) and stannic oxide (90% to 70%).

A preferred class of ureas correspond with the general formula

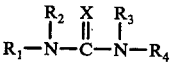

wherein X is oxygen or sulphur and $R_1$, $R_2$, $R_3$ and $R_4$ are the same or different and represent hydrogen, alkyl, cycloalkyl, aryl, alkaryl, arakyl or acyl groups or wherein $R_1$ and $R_4$ together represent a divalent organic radical forming a cyclic urea in which the urea moiety is part of the ring.

The above mentioned groups can also have substituents thereon, such as halogen e.g. chlorine, hydroxyl and nitro groups.

Specific examples of ureas which may be used to advantage include urea; alkyl ureas such as methylurea, s-dimethylurea, ethylurea, allylurea, s-diethylurea, n-propylurea, n-s-dipropylurea, tetramethylurea and tetraethylurea; aryl ureas such as phenylurea, s-diphenylurea, tetraphenylurea, and N, $N^1$-diethyl-N, $N^1$-diphenylurea (ethyl centralite); aralkyl ureas such as benzylurea; acyl ureas such as acetylurea and biuret; hydroxyalkyl ureas such as methylolurea; alkaryl ureas such as p-tolylurea; thiourea; alkyl thioureas such as methylthiourea, ethylthiourea and s-diethylthiourea; aryl thioureas such as phenylthiourea and diphenylthiourea; aralkyl thioureas such as benzylthiourea; and cyclic ureas such as glycolylurea, oxalylurea and malonylurea.

Further, a preferred group of ureas is obtained by reacting selected mono- and polyisocyanates with an excess of water in the presence of a solvent e.g. acetone. Isocyanates which can be used for this purpose include methyl isocyanate, ethyl isocyanate, phenylisocyanate, 2,4 tolyene diisocyanate, hexamethylene diisocyanate, and methylene-di-p-phenylene diisocyanate.

The above mentioned ureas and reaction produced ureas produced suitable results in the pyrolysis reaction of a mixture of selected ureas and heavy metal oxides when 5%–30% by weight, of the urea, was added to lead stannate, chosen mixtures of lead oxide and stannic oxide or chosen mixtures of lead sesquioxide and stannic oxide.

The pyrolysis reaction may be carried out at a variety of temperatures (350°–550° C) with a reaction time between 1–2 hours.

Although it is not intended that the invention be limited thereto, there is set forth herein below for purposes of illustration, examples of how the ballistic modifier may be produced and a propellant composition into which it may be incorporated to provide mesa or plateau burning characteristics.

EXAMPLE I 90 grams of lead stannate (dried at 110° C) is mixed thoroughly with 10 grams of a solid formed by the reaction of 2,4 tolyelene diisocyanate, water and acetone. The mixture is transferred to an aluminum container which is placed in a furnace having a non-oxidizing atmosphere. The mixture is sintered at 500°-550° C for 60 minutes, cooled thoroughly in an inert atmosphere such as nitrogen gas and then screened through a No. 325 mesh sieve. The pyrolyzed mixture is then hand mixed with a plastisol propellant formulation, cast into appropriate molds and cured in an oven at 60° C overnight.

A preferred plastisol propellant formulation consisted essentially of: ball powder (19800) 18.50%, ball powder-quick gel (2161) (74% nitrocellulose, 24% nitroglycerin and 2% 2-nitro diphenyl amine) 1.00%, HMX (cyclotetramethylene tetranitramine homocyclonite) 30.00%, casting solvent X (65% ethylene glycol dinitrate, 34% butanetriol trinitrate and 1% 2-nitrophenyl amine) 46.50% and ballistic modifier 4.00%.

EXAMPLE II 80 grams of commercial lead stannate (dried at 110° C) is mixed thoroughly with 20 grams of phenyl urea. The mixture is pyrolyzed at 525°-550° C for 60 minutes using the procedure described in Example I. The resulting product is added to a propellant composition as described in Example I.

EXAMPLE III 80 grams of commercial lead stannate (dried at 110° C) is thoroughly mixed with 20 grams of diphenyl urea and the mixture pyrolyzed at 525°-550° C for 60 minutes using the procedure described in Example I.

The modifier is then incorporated into a propellant composition such as illustrated in Example I.

EXAMPLE IV 80 grams of commercial lead stannate (dried at 110° C) is thoroughly mixed with 20 grams of a solid produce from the reaction of hexamethylene diisocyanate, water and acetone. The resulting mixture is pyrolyzed and added to a propellant composition as illustrated in Example I.

EXAMPLE V 85 grams of commercial lead stannate (dried at 110° C) is mixed thoroughly with 15 grams of a solid formed by the reaction of 2,4 tolylene diisocyanate, water, and acetone. The resulting mixture is pyrolyzed and added to a propellant composition as illustrated in Example I.

The advantages of the invention will be better understood from the description which follows take in connection with the drawings and tables which form a part of this specification. The figures represent graphs of the pressure-burning rate relationships for various propellants tested.

Standard procedures were used to determine burning rates which were carried out in a Crawford strand burning rate apparatus.

TABLE I

BURNING PROPERTIES OF THE MODIFIERS PRODUCED FROM VARIOUS UREAS

| Organic Compound | Amount of Urea Added % | Pyrolysis Temp. (° C) | Pyrolysis Time (min.) | Pressure index at 70° F (800–1600 psi) | Burning Rate at 1000 psi in/sec. |
|---|---|---|---|---|---|
| Urea | 25.0 | 525–550 | 60 | 0.40 | 0.34 |
| Phenyl Urea | 20.0 | 525–550 | 60 | 0.21 | 0.44 |
| Diphenyl Urea | 20.0 | 525–550 | 60 | 0.17 | 0.37 |
| Ethyl Centralite | 20.0 | 525–550 | 60 | 0.02 | 0.35 |
| TDI Urea | 20.0 | 525–550 | 60 | 0.02 | 0.38 |
| | | | | 0.81* | 0.21 |
| | | | | 0.65** | 0.29 |

*Control Plastisol Propellant without modifier
**Control Plastisol Propellant with only Lead Stannate as modifier

TABLE II

BURNING PROPERTIES OF THE MODIFIERS PRODUCED FROM DIISOCYANTES

| Diisocyanate Substituted Urea Compound | Diisocyanate Added % | Pyrolysis Temp. (° C) | Pyrolysis Time (min.) | Pressure Index at 70° F (600–1600 psi) | Burning Rate at 1000 psi in/sec) |
|---|---|---|---|---|---|
| Hexamethylene | 20.0 | 500–550 | 60.0 | 0.06 | 0.36 |
| Methylene-di-p-phenylene | 20.0 | 500–550 | 60.0 | 0.19 | 0.36 |
| 2,4-Tolylene | 10.0 | 500–550 | 60.0 | 0.16 | 0.41 |
| 2,4-Tolylene | 15.0 | 500–550 | 60.0 | 0.10 | 0.43 |
| 2,4-Tolylene | 20.0 | 500–550 | 60.0 | 0.08 | 0.40 |
| | | | | 0.81* | 0.21 |
| | | | | 0.65** | 0.29 |

*Control Plastisol Propellant without modifier
**Control Plastisol Propellant with only Lead Stannate as modifier

TABLE III

Effect of Time of Pyrolysis on the Reaction of $PbSnO_3$ and 2,4 Tolylene Diisocyanate Substituted Urea Compound

| 2,4 Tolylene Diisocyanate Substituted Urea Compound % | Pyrolysis Temp. ° C | Pyrolysis Time (Min) | Pressure Exponent at 70° F 800–1600 psi | Burning Rate At 100 psi (in/sec) |
|---|---|---|---|---|
| 20.0 | 550° ± 25° | 30 | 0.09 | 0.37 |
| 20.0 | 550° ± 25° | 60 | 0.07 | 0.36 |
| 20.0 | 550° ± 25° | 90 | 0.11 | 0.35 |
| 20.0 | 550° ± 25° | 120 | 0.06 | 0.45 |
| | | | 0.81* | 0.21 |

TABLE III-continued

Effect of Time of Pyrolysis on the Reaction of $PbSnO_3$ and 2,4 Tolylene Diisocyanate Substituted Urea Compound

| 2,4 Tolylene Diisocyanate Substituted Urea Compound % | Pyrolysis Temp. ° C | Pyrolysis Time (Min) | Pressure Exponent at 70° F 800–1600 psi | Burning Rate At 100 psi (in/sec) |
|---|---|---|---|---|
| | | | 0.65** | 0.29 |

*Control Plastisol propellant without modifier
**Control Plastisol propellant with only $PbSnO_3$ as modifier

TABLE IV

The Effect of Concentration of 2,4 Tolylene Diisocyanate Substituted Urea Compound on Pyrolysis Reaction with $PbSnO_3$

| 2,4 Tolylene Diisocyanate Substituted Urea Compound % | Pyrolysis Temp. ° C | Pyrolysis Time (Min.) | Pressure Exponent at 70° F (800–1600 psi) | Burning Rate At 1000 psi (in/sec.) |
|---|---|---|---|---|
| 5.0 | 550° ± 25° | 120 | 0.10 | 0.39 |
| 10.0 | 550° ± 25° | 120 | 0.05 | 0.42 |
| 15.0 | 550° ± 25° | 120 | 0.04 | 0.43 |
| 20.0 | 550° ± 25° | 120 | 0.06 | 0.45 |
| 25.0 | 550° ± 25° | 120 | 0.07 | 0.45 |
| 30.0 | 550° ± 25° | 120 | 0.05 | 0;.45 |
| | | | 0.81* | 0.21 |
| | | | 0.65** | 0.29 |

*Control Plastisol propellant without modifier
**Control Plastisol propellant with only $PbSnO_3$ as modifier

TABLE V

The Effect of Temperature on the Pyrolysis of $PbSnO_3$ and 2,4 Tolylene Diisocyanate Urea Compound

| 2,4 Tolylene Diisocyanate Substituted Urea Compound % | Pyrolysis Temp. ° C | Pyrolysis Time (Min.) | Pressure Exponent at 70° F (800–1600 psi) | Burning Rate At 100 psi (in/sec) |
|---|---|---|---|---|
| 20.0 | 350–400 | 60 | 0.14 | 0.43 |
| 20.0 | 400–450 | 60 | 0.08 | 0.42 |
| 20.0 | 450–500 | 60 | 0.05 | 0.37 |
| 20.0 | 500–550 | 120 | 0.06 | 0.45 |
| | | | 0.81* | 0.21 |
| | | | 0.65** | 0.29 |

*Control Plastisol propellant without modifier
**Control Plastisol propellant with only $PbSnO_3$ as modifier As is demonstrated by Tables I to V the pyrolysis reaction may be carried out at a variety of temperatures, concentrations and times and with a wide range of organic compounds without a significant change in the desired pressure index, exponent or burning rate.

Further an examination of FIGS. 1 through 10 illustrates the plateau properties which are imparted to a HMX (30%) plastisol propellant when the ballistic modifier produced from the pyrolysis of heavy metal oxides and various urea compounds is added to the propellant mixture.

Optimum modification occurs when the urea compound is a substituted urea produced from the water-isocyanate reaction (FIGS. 5–10).

Thus, through the practice of our invention, plateau burning rates may be obtained in plastisol propellants by use of a ballistic modifier which is inexpensive, less time consuming and requires little procedural control in its production.

We wish it to be understood that we do not desire to be limited to the exact processes shown and described for obvious modification will occur to a person skilled in that art.

We claim:

1. A ballistic modifier comprising the pyrolysis product of a mixture of a urea and a metal compound selected from the group consisting of lead stannate and a mixture of lead oxide and tin oxide.

2. The ballistic modifier of claim 1, wherein the urea constitutes 5 – 30% by weight and the metal compound constitutes 70 – 95% by weight of said mixture.

3. The ballistic modifier of claim 2, wherein the metal compound is a mixture of lead oxide and stannic oxide.

4. The ballistic modifier of claim 3, wherein the lead oxide and stannic oxide are in the weight ratios of 10% – 90% lead oxide to 90% – 10% stannic oxide.

5. The ballistic modifier of claim 3, wherein the lead oxide is lead sesquioxide in the weight ratios of 10% – 30% lead sesquioxide to 90% – 70% stannic oxide.

6. The ballistic modifier of claim 2, wherein the metal compound is lead stanate.

7. The ballistic modifier of claim 6 wherein the urea is a reaction product of an organic isocyanate and water.

8. The ballistic modifier according to claim 7 wherein the organic isocyanate is a monoisocyanate or a polyisocyanate.

9. The ballistic modifier according to claim 7 wherein the organic isocyanate is a monoisocyanate chosen from the group consisting of methyl isocyanate, ethyl isocyanate and phenylisocyanate.

10. The ballistic modifier according to claim 7 wherein the organic isocyanate is a polyisocyanate selected from the group consisting of 2,4 tolylene diisocyanate, hexamethylene diisocyanate, and methylene-di-p-phenyl diisocyanate.

11. The ballistic modifier of claim 6 wherein the urea has the formula

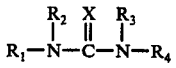

in which X is oxygen or sulphur and $R_1$, $R_2$, $R_3$ and $R_4$ are the same or different and are hydrogen, alkyl, cycloalkyl, aryl, alkaryl, aralkyl, and acyl groups.

12. The ballistic modifier of claim 6 wherein the urea has the formula

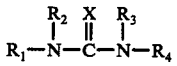

in which X is oxygen, $R_1$ is an aryl group and $R_2$, $R_3$, $R_4$ are hydrogens.

13. The ballistic modifier of claim 6 wherein the urea has the formula

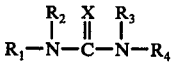

in which X is oxygen, $R_1$ and $R_3$ are aryl groups, and $R_2$ and $R_4$ are hydrogens.

* * * * *